US006696789B2

(12) United States Patent
Sukeno et al.

(10) Patent No.: US 6,696,789 B2
(45) Date of Patent: Feb. 24, 2004

(54) COLOR PICTURE TUBE DEVICE

(75) Inventors: Masahiko Sukeno, Takatsuki (JP); Kazunori Ohta, Takatsuki (JP); Yasuyuki Ueda, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/428,306

(22) Filed: May 2, 2003

(65) Prior Publication Data

US 2003/0209988 A1 Nov. 13, 2003

(30) Foreign Application Priority Data

May 10, 2002 (JP) ..... 2002-135104

(51) Int. Cl.[7] ..... G09G 1/04

(52) U.S. Cl. ..... 315/16; 315/368.15; 315/382; 313/414; 313/419

(58) Field of Search ..... 315/16, 15, 368.15, 315/382; 313/414, 419

(56) References Cited

U.S. PATENT DOCUMENTS 4,935,663 A * 6/1990 Shimoma et al. ..... 313/412

FOREIGN PATENT DOCUMENTS

JP 7-6706 1/1995

* cited by examiner

*Primary Examiner*—David Vu

(74) *Attorney, Agent, or Firm*—Merchant & Gould, P.C.

(57) ABSTRACT

The present invention provides a high-resolution color picture tube device with a decreased beam spot diameter. The color picture tube device has an electron gun including cathodes, a control electrode, an accelerating electrode, a G3 electrode, a first focusing electrode, a second focusing electrode, and a final accelerating electrode that are arranged in this order. A voltage applied to the G3 electrode is obtained by dividing with a resistor a voltage applied to the final accelerating electrode, and when an electron beam is a non-deflection state, a relationship represented as Va>Vg3>Vfoc2 is satisfied where Va, Vg3, and Vfoc2 denote voltages respectively applied to the final accelerating electrode, the G3 electrode and the second focusing electrode. Thereby, the G3 electrode is applied with a high voltage independently for forming a prefocus lens.

10 Claims, 4 Drawing Sheets

COLOR PICTURE TUBE DEVICE

BACKGROUND OF THE INVENTION

The present invention relates to a color picture tube device configured to obtain a high resolution across a whole screen of a picture tube. More specifically, the present invention relates to an electron gun used in the color picture tube device.

FIELD OF THE INVENTION

A color picture tube is required to have a high resolution. FIG. 8 shows an example of a conventional electron gun providing a high resolution color picture tube with a reliable and simple configuration, which is disclosed in JP 07(1995) 6706. As shown in FIG. 8, an electron gun 100 has cathodes 101, a control electrode 102, an accelerating electrode 103, a G3 electrode 104, a first focusing electrode 105, a second focusing electrode 106, a final accelerating electrode 107 and a shield cup 108, which are arranged in this order. The accelerating electrode 103 and the G3 electrode 104 form a prefocus lens, while the second focusing electrode 106 and the final accelerating 107 form a main lens.

A constant voltage Vg3 (9.0 kV) is applied to the G3 electrode 104, while a constant voltage Vfoc2 (6.5 kV) and a dynamic voltage Vd superimposed thereon are applied to the second focusing electrode 106, thereby keeping a relationship of Vg3>Vfoc2.

The dynamic voltage, which is 0V when the deflection angle of an electron beam is 0, will rise gradually with the increase of the deflection angle. This strengthens a quadrupole lens electric field formed by the first focusing electrode 105 and the second focusing electrode 106.

In this configuration, the voltage Vg3 at the prefocus lens side can be applied separately from the voltage Vfoc2 configuring a main lens at the low voltage side. Thereby, the voltage Vfoc2 can be set lower than Vg3 while maintaining the level of the voltage Vg3. In this manner, the characteristics of the prefocus lens are maintained and a reliable color picture tube device having a high resolution can be provided.

In such a conventional electron gun, a sufficient potential difference is maintained between the voltage Vg3 (9.0 kV) and a voltage of the accelerating electrode 103, as the voltage of the accelerating electrode 103 is equal to the voltage Vfoc1 (600 V) applied to the first focusing electrode 105. However, a potential difference between the first focusing electrode 105 (600 V) and the second focusing electrode 106 (6.5 kV) is increased, causing the formation of a considerably strong quadrupole lens when an electron beam is not deflected. As a result, the quadrupole lens will have an increased astigmatism, limiting a reduction of the spot diameter of the electron beam on the screen.

Moreover in this configuration, Vfoc1 is lower than Vfoc2 under a non-deflection condition, and the dynamic voltage Vd is raised gradually with the increase in the deflection angle so as to change the quadrupole lens, and thus the sensitivity in correcting the deflection astigmatism with respect to the dynamic voltage is inferior.

SUMMARY OF THE INVENTION

In order to solve the above-described problems in conventional techniques, an object of the present invention is to provide a color picture tube device with a small beam spot diameter to provide a high resolution.

For achieving the above-described object, a first color picture tube device according to the present invention has an electron gun including cathodes, a control electrode, an accelerating electrode, a G3 electrode, a first focusing electrode, a second focusing electrode and a final accelerating electrode that are arranged in this order. A voltage applied to the G3 electrode is obtained by dividing with a resistor a voltage applied to the final accelerating electrode, and a relationship represented as Va>Vg3>Vfoc2 is satisfied when an electron beam is not deflected, where Va denotes the voltage applied to the final accelerating electrode, Vg3 denotes the voltage applied to the G3 electrode, and Vfoc2 denotes a voltage applied to the second focusing electrode.

A second color picture tube device according to the present invention has an electron gun including cathodes, a control electrode, an accelerating electrode, a G3 electrode, a first focusing electrode, a second focusing electrode and a final accelerating electrode that are arranged in this order. A voltage applied to the G3 electrode is obtained by dividing with a resistor a voltage applied to the final accelerating electrode, a relationship represented as Vg3>9 kV is satisfied, and a relationship represented as Va>Vg3>Vfoc1>Vfoc2 is satisfied when an electron beam is not deflected, where Va denotes the voltage applied to the final accelerating electrode, Vg3 is a voltage applied to the G3 electrode, Vfoc1 denotes a voltage applied to the first focusing electrode and Vfoc2 denotes a voltage applied to the second focusing electrode.

DETAILED DESCRIPTION OF THE INVENTION

Figure 1:
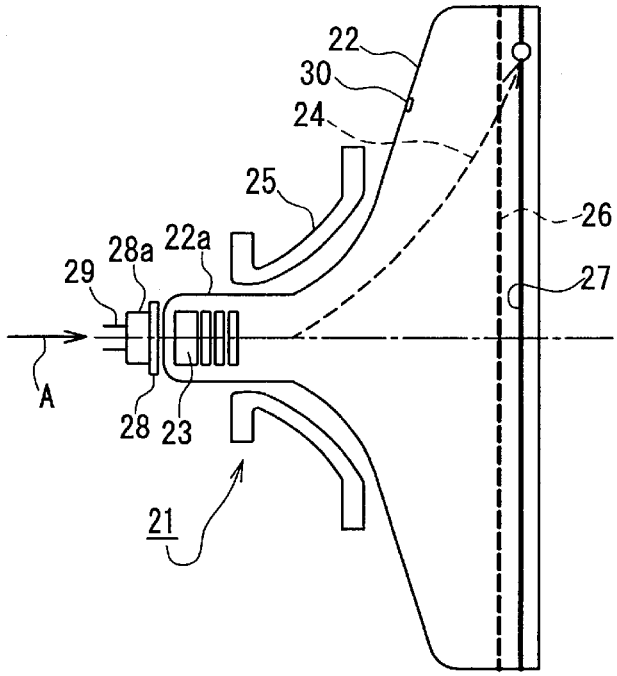
FIG. 1 is a cross-sectional view showing a color picture tube device according to one embodiment of the present invention.

In the first color picture tube device of the present invention, since a voltage applied to the G3 electrode is obtained by dividing with a resistor a voltage applied to the final accelerating electrode, the G3 electrode can be applied with a voltage separately from the first focusing electrode and the second focusing electrode. Thereby, the first focusing electrode and the second focusing electrode are applied with high voltages, and further the G3 electrode can be applied with a high voltage independently for forming a prefocus lens.

According to a second color picture tube device of the present invention, the voltage Vg3 applied to the G3 electrode can be increased to strengthen the prefocus lens. In addition, by setting the lower voltages Vfoc1 and Vfoc2 in a relationship of Vfoc1>Vfoc2 not deflected, the quadrupole lens for correcting the deflection astigmatism formed from the screen center can be weakened with the rise in the dynamic voltage, and this can improve the sensitivity in correcting the deflection astigmatism with respect to the dynamic voltage and also reduce the amount of the dynamic voltage. Therefore, an electron gun with a smaller beam spot diameter and an excellent focusing property can be provided.

In each of the first and second color picture tube devices, it is preferable that the accelerating electrode and the G3 electrode are applied with voltages separately from the voltages applied to the first and second focusing electrodes, and that a lens electric field between the accelerating electrode and the G3 electrode, and a lens electric field between the first focusing electrode and the second focusing electrode, are formed respectively with independently-applied voltages. In this configuration, it is possible to maintain the focusing action of a prefocus lens formed between the G3 electrode and the accelerating electrode, while preventing a quadrupole lens formed between the first focusing electrode and the second focusing electrode from being strengthened excessively when an electron beam is not deflected.

In any of the first and second color picture tube devices, it is preferable that the G3 electrode is applied with a voltage that is obtained by dividing with a resistor a voltage supplied from an anode in the color picture tube device to the final accelerating electrode, and that the first and second focusing electrodes are applied with voltages that are supplied through pins of a stem provided in the color picture tube device. According to the configuration, a limited number of pins of a stem for a high voltage can be used effectively. Moreover, it is possible to apply the G3 electrode with a voltage higher than the upper limit of the voltage supplied through the pins of the stem.

It is preferable in the first color picture tube device that the voltage Vg3 is higher than 9 kV thereby strengthening focusing action of a prefocus lens formed between the accelerating electrode and the G3 electrode.

It is preferable in any of the first and second color picture tube devices that an intermediate electrode is arranged between the second focusing electrode and the final accelerating electrode, and that a voltage (Vm) applied to the intermediate electrode is higher than Vfoc1. Accordingly, a main lens electric field can be extended in the axial direction of the electron gun and the effective lens diameter of the main lens can be enlarged, thereby further decreasing the spot diameter of the electron beam.

Color picture tube devices according to one embodiment of the present invention are explained below by referring to the attached drawings.

First Embodiment

FIG. 1 is a cross-sectional view showing a color picture tube device according to one embodiment of the present invention. In FIG. 1, an electron gun 23 is provided within a neck portion 22*a* of a glass bulb 22 of a color picture tube device 21. An electron beam 24 emitted from the electron gun 23 is deflected by a deflection yoke 25, and reaches a phosphor screen 27 through a shadow mask 26 as a color selection electrode. A stem 28 with pins 29 is provided at an end of the neck portion 22*a*, and a voltage used in the electron gun 23 is supplied through the pins 29. Here, the stem 28 is provided with a gun base 28*a* to expose the pins 29.

Figure 2:
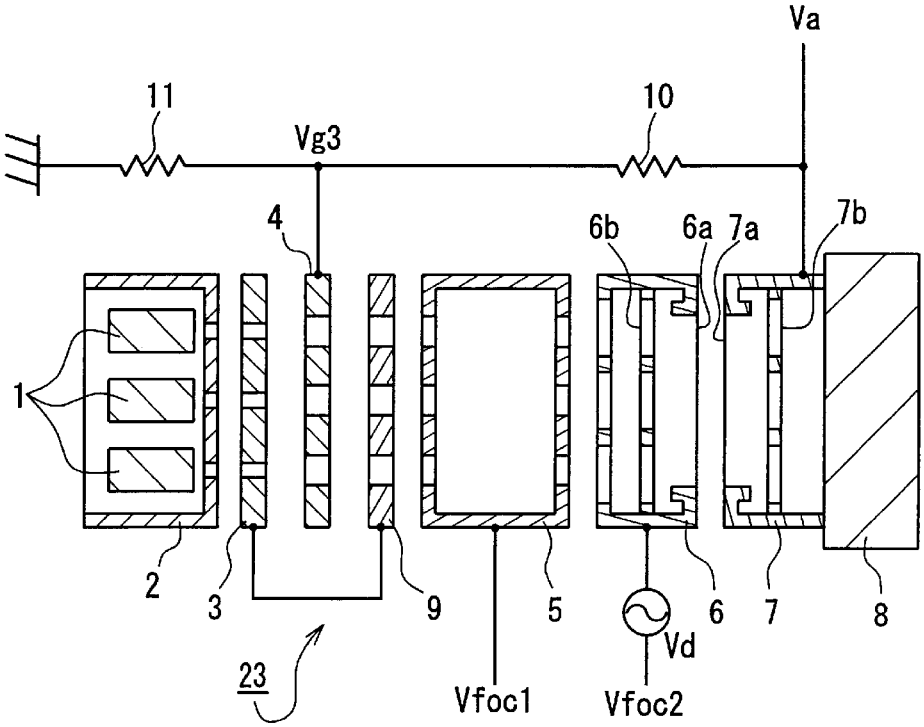
FIG. 2 is a cross-sectional view showing an electron gun according to a first embodiment of the present invention.

FIG. 2 is a cross-sectional view showing a main part of the electron gun 23 in FIG. 1. The electron gun 23 is configured with cathodes 1 that are in-line placed corresponding to three colors of RGB, a control electrode 2 (G1 electrode), an accelerating electrode 3 (G2 electrode), a G3 electrode 4, a first focusing electrode 5, a second focusing electrode 6, a final accelerating electrode 7 and a shield cup 8, which are arranged in this order in the axial direction of the color picture tube.

An auxiliary electrode 9 is arranged between the G3 electrode 4 and the first focusing electrode 5. This auxiliary electrode 9 is connected electrically to the accelerating electrode 3, so that these two electrodes will have an identical potential when applied with a voltage.

The G3 electrode 4 and the final accelerating electrode 7 are connected electrically to each other through a resistor 10 provided in the vicinity of the internal electron gun 23, and further the G3 electrode 4 is grounded through a resistor 11 provided in the vicinity of the electron gun 23. Thereby, a voltage Va applied to the final accelerating electrode 7 is divided in the potential, and the thus divided voltage Vg3 is applied to the G3 electrode 4.

The first focusing electrode 5 is applied with a voltage Vfoc1, and the second focusing electrode 6 is applied with a voltage Vfoc2 and a dynamic voltage Vd superimposed thereon. The dynamic voltage Vd, which is 0 V when the deflection angle of an electron beam is 0, will rise gradually with an increase of the deflection angle.

The accelerating electrode 3, the G3 electrode 4 and the auxiliary electrode 9 are formed as flat plates, each of which is provided with three apertures formed corresponding to three electron beams. Similarly, three apertures are formed in the control electrode 2. The first focusing electrode 5 is a tubular electrode sealed with flat plates at the auxiliary electrode 9 side and at the second focusing electrode 6 side, and each of the flat plates is provided with three apertures for passing electron beams. The accelerating electrode 3, the G3 electrode 4 and the auxiliary electrode 9 will not be limited to flat plates, but these electrodes can be formed to be tubular. Similarly, the first focusing electrode 5 and the second focusing electrode 6 will not be limited to tubes, but these electrodes can be formed as thick plates.

Both the second focusing electrode 6 and the final accelerating electrode 7 are tubular electrodes, and each has an opening 6*a* or 7*a* at the end for passing three electron beams RGB. Plate-shaped field-forming electrodes 6*b*, 7*b* are arranged inside the tubes with respect to the openings 6*a* or 7*a*. These field-forming electrodes 6*b*, 7*b* are used for separating the lens electric field into lenses corresponding to the three electron beams, and each of the field-forming electrodes 6*b*, 7*b* is provided with three apertures corresponding to be respective three electron beams.

By configuring the second focusing electrode 6 and the final accelerating electrode 7 as described above, the three adjacent lens electric fields overlap each other in the horizontal direction (the in-line alignment direction of the cathodes 1), thereby substantially increasing the lens diameter.

The lens diameter can be adjusted corresponding to the shape and diameter of the openings in the tubular electrodes 6, 7, the shape and diameter of each aperture of the field-forming electrodes 6*b*, 7*b*, and the position of the field-forming electrode 6*b*, 7*b* in a relation with the openings 6*a*, 7*a* of the tubular electrodes 6, 7. The flat plate field-forming electrodes 6*b*, 7*b* can be replaced by screen-like electrodes.

When respective electrodes of the thus configured electron gun are applied with certain voltages, a prefocus lens is formed between the accelerating electrode 3 and the G3 electrode 4. In addition, a uni-potential type focusing lens is formed with the G3 electrode 4, the auxiliary electrode 9 and the first focusing electrode 5. Between the first focusing lens 5 and the second focusing lens 6, a quadrupole electrode that corrects deflection astigmatism varying its strength with electron beams being deflected around the screen is formed, while a main lens is formed between the second focusing lens 6 and the final accelerating lens 7.

In a case of a color TV picture tube with a 76 cm type or 86 cm type (aspect ratio of 16:9) large screen, the voltage to be applied to the control electrode 2 is substantially 0 V, about 300 V to 800 V to the accelerating electrode 3 and the auxiliary electrode 9, and about 4 kV to 9 kV as a voltage Vfoc1 to the first focusing electrode 5.

The second focusing electrode 6 is applied with a voltage formed by superimposing on a voltage Vfoc2 of about 4 kV to 9 kV a dynamic voltage Vd that varies depending on deflection.

Figure 3:
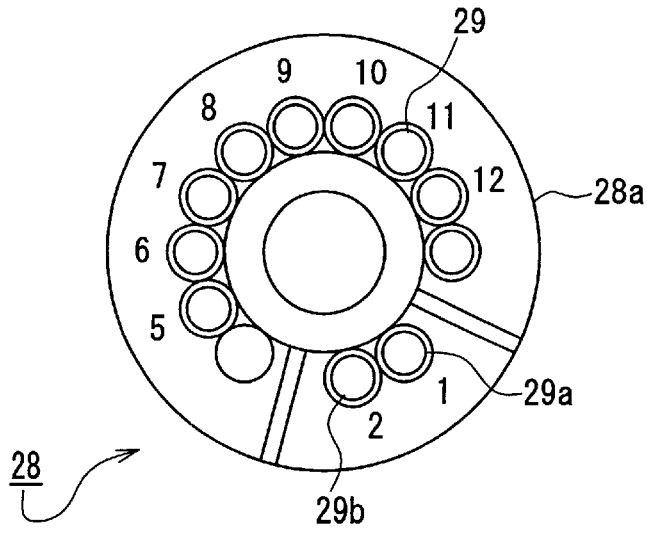
FIG. 3 shows a gun base that is viewed in the direction pointed as 'A' in FIG. 1.

FIG. 3 shows the gun base 28*a* in FIG. 1 viewed in the direction identified with an arrow 'A'. The stem 28 provided with the gun base 28*a* has plural pins 29 arranged substantially around its circumference. Voltages applied to the above-described control electrode 2, the accelerating electrode 3, the auxiliary electrode 9, the first focusing electrode 5 and the second focusing electrode 6 will be supplied through the pins 29. The voltage Vfoc1 and Vfoc2 applied respectively to the first focusing electrode 5 and the second focusing electrode 6 are supplied through the pins 29*a* and 29*b* spaced from the other pins, since the voltages are higher than the voltages applied to the remaining electrodes.

The final accelerating electrode 7 is applied with a voltage Va of about 20 kV to 35 kV. The voltage Va is supplied from an anode contact 30 (FIG. 1) on the glass bulb 22 of the picture tube device through a conductive film on the inner surface of the envelope 22. In this case, the voltage Vg3, which is obtained by dividing the voltage Va with the resistor 10, will not be supplied necessarily through the pins 29 of the stem 28.

In this configuration, a relationship represented as Va>Vg3>Vfoc1>Vfoc2 is maintained when an electron beam is not deflected, where Va denotes a voltage supplied from the anode contact 30, Vg3 denotes a voltage obtained by dividing the voltage Va, and Vfoc1 and Vfoc2 are supplied through the pins 29 of the stem 28. For example, when Va is 29.5 kV, Vg3 is 11 kV, Vfoc1 is 7 kV, and Vfoc2 is 6 kV.

Vg3, which is higher than Vfoc1 and Vfoc2, can strengthen the prefocus lens. Furthermore, due to the relationship of Vfoc1>Vfoc2, a potential difference between the first focusing electrode 5 and the second focusing electrode 6 is decreased with the rise of the dynamic voltage Vd. Thereby, the quadrupole lens for correcting the deflection astigmatism formed from the screen center can be weakened with the rise of the dynamic voltage. Namely, the sensitivity in correcting the deflection astigmatism with respect to the dynamic voltage Vd can be improved, and the amount of the dynamic voltage Vd can be reduced.

The voltage Vg3 is obtained by dividing the voltage Va from the anode contact 30. Therefore, it can be a high voltage, just the voltages Vfoc1 and Vfoc2, both of which are supplied through the pins 29 of the stem 28, are high. In this case, even an increased voltage Vg3 will affect the main lens less, and the prefocus lens and the main lens can be optimized independently to decrease the spot diameter of the electron beam.

As described above, raising the voltage supplied to the pins 29 of the stem 28 may cause an electrical discharge among the adjacent pins, and the number of pins to be applied with the high voltage is limited to two, i.e., the pins 29*a* and 29*b* in FIG. 2. In the conventional configuration as shown in FIG. 8, two pins for high voltage are used in the G3 electrode 104 for forming a prefocus lens and also in the second focusing electrode 106 for forming a main lens.

In this case, Vfoc1 applied to the first focusing electrode 105 though the pins cannot be raised considerably. As a result, a potential difference between the first focusing electrode 105 (600 V) and the second focusing electrode 106 (6.5 kV) is increased, resulting in formation of an extremely strong quadrupole lens when the electron beam is not deflected.

In this embodiment, the voltage Vg3 can be raised as well as the voltages Vfoc1 and Vfoc2, while the accelerating electrode 3 opposing the G3 electrode 4 applied with the high voltage Vg3 can be applied with a low voltage through the pins 29 of the stem 28, and the low voltage is applied separately from the voltage Vfoc1. That is, a lens electric field between the accelerating electrode 3 and the G3 electrode 4, and a lens electric field between the first focusing electrode 5 and the second focusing electrode 6, are formed respectively with independently-applied voltages. Therefore, the focusing action of the prefocus lens formed between the G3 electrode 4 and the accelerating electrode 3 is secured, while the quadrupole lens formed between the first focusing lens 5 and the second focusing lens 6 is prevented from being strengthened excessively when the electron beam is not deflected.

Figure 4:
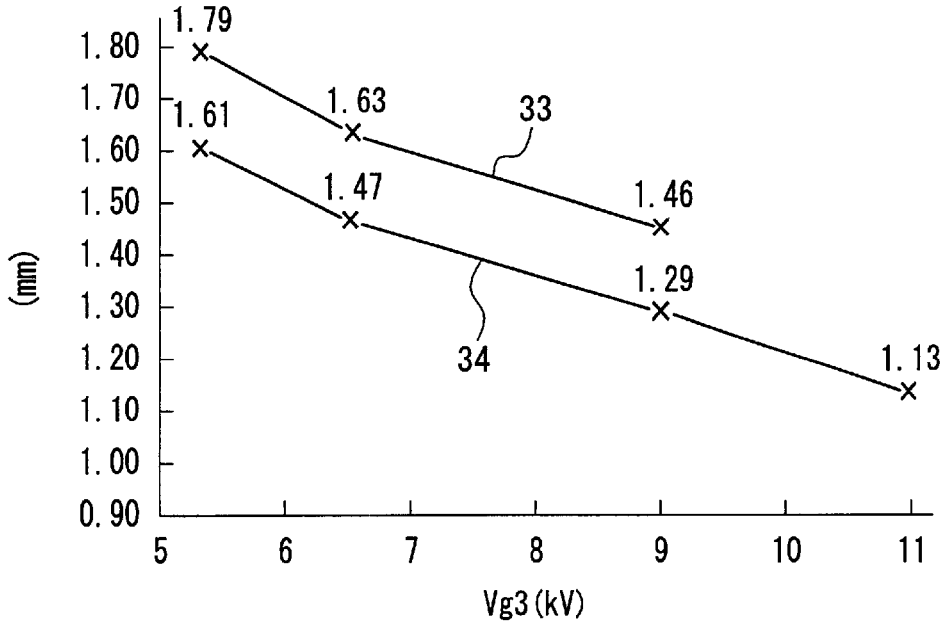
FIG. 4 is a graph showing a relationship between a voltage Vg3 and a spot diameter of an electron beam in a case of using the electron gun according to the first embodiment of the present invention.
Figure 8:
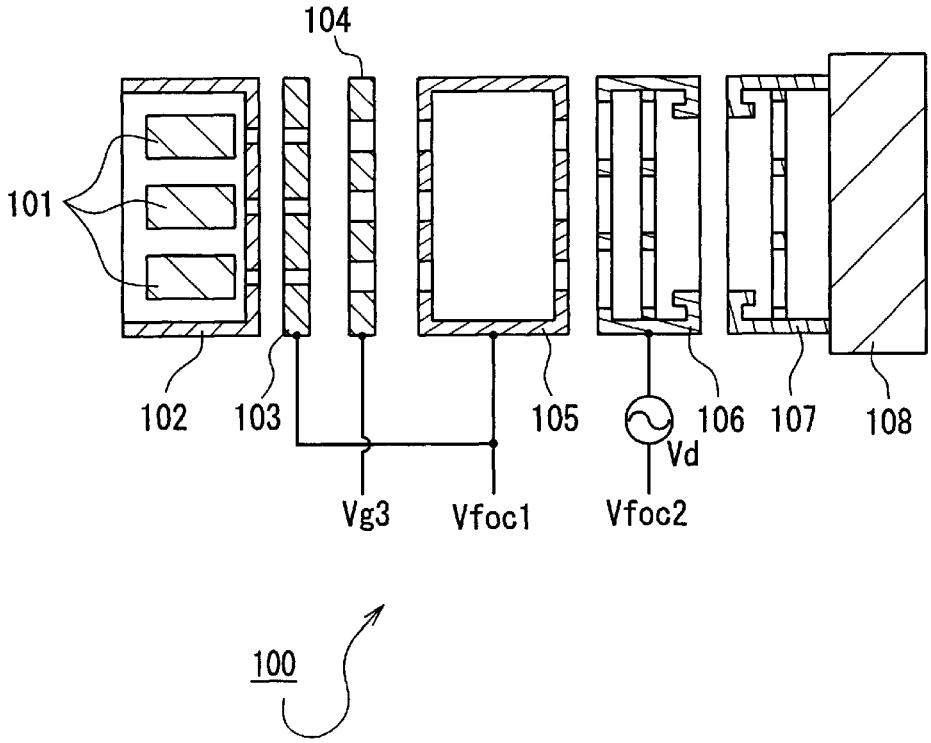
FIG. 8 PRIOR ART
FIG. 8 is a cross-sectional view of a conventional electron gun.

In the conventional configuration as shown in FIG. 8, the voltage Vg3 can be raised. However, there is an upper limit in the applied voltage, since the voltage Vg3 is supplied through the pins of the stem. More specifically, the upper limit of the voltage applied to the pins is about 9 kV, since an electrical discharge may occur among the adjacent pins as the voltage supplied to the pins is raised. In the embodiment of the present invention, since the voltage Vg3 is obtained by dividing the voltage Va from the anode contact, the applied voltage can be over 9 kV An experimental result about a relationship between the voltage Vg3 and the beam spot diameter for an electron gun according to this embodiment is shown in FIG. 4. In this experiment, Va, Vfoc1 and Vfoc2 were fixed respectively to 29.5 kV, 7 kV, and 6 kV, while only Vg3 was varied.

In the experiment, diameters of apertures formed in the control electrode 2, the accelerating electrode 3 and the G3 electrode 4 were determined respectively to 0.5 mm, 0.5 mm, and 0.9 mm, and the effective lens diameter of the main lens was determined to be about 11 mm.

Experimental results for an electron gun in a comparative example are also shown in the same figure. The electron gun in the comparative example was the same as the example of the present invention, except that Vfoc1=600 V and Vfoc2= 6.5 kV.

As shown in FIG. 4, the spot diameter (y-axis) is decreased as the voltage Vg3 (x-axis) is raised for both the example (line 34) and the comparative example (line 33). However, the spot diameter for the line 34 is smaller by about 10% in comparison with that of the line 33 when Vg3 of the electron gun of the example was equal to that of the comparative example.

As mentioned above, the upper limit of the voltage applied through the pins of the stem is 9 kV in the conventional electron gun. On the other hand, no discharges occurred among the pins of the stem even when Vg3 exceeded 9 kV in this example where Vg3 was not applied through the pins of the stem but supplied by dividing a voltage Va from the anode contact through a division resistor. The values for Vg3 over 11 kV are omitted from the figure, since there was no substantial change in the spot diameter after Vg3 exceeded this value.

Second Embodiment

Figure 5:
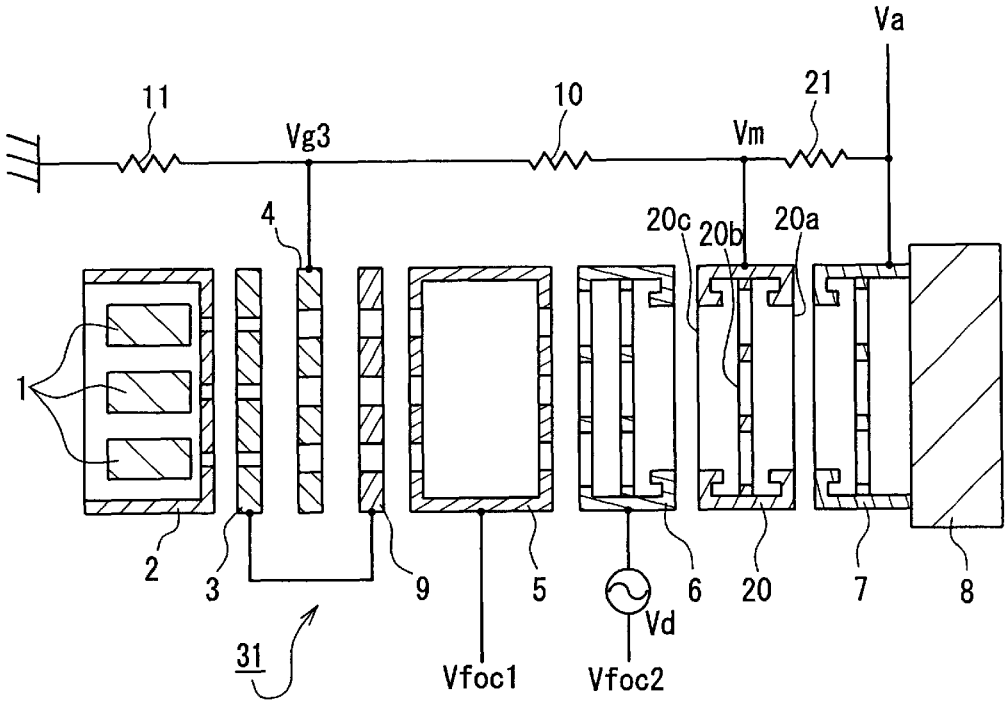
FIG. 5 is a cross-sectional view showing an electron gun according to a second embodiment of the present invention.

Next, an electron gun according to a second embodiment of the present invention will be described by referring to FIG. 5. As shown in FIG. 5, an electron gun 31 in the second embodiment is substantially identical to the electron gun 23 shown in FIG. 1, except that an intermediate electrode 20 is arranged between the second focusing electrode 6 and the final accelerating electrode 7. This intermediate electrode 20 is connected electrically to the final accelerating electrode 7 through a resistor 21. Thereby, the intermediate electrode 20 is applied with a voltage Vm that is obtained by dividing the voltage Va.

Similar to the second focusing electrode 6 and the final accelerating electrode 7, the intermediate electrode 20 is formed as a tubular electrode having openings 20*a*, 20*c* formed opposing the electrodes at the both sides, and a field-forming electrode 20*b* as a flat plate having three apertures is provided in the vicinity of the center of the interior. Explanations for components numbered identically to those of FIG. 1 are omitted in the figure, as the components have the same configurations. A plurality of intermediate electrodes can be provided in the axial direction. A configuration providing a screen-like electrodes to the field-forming electrode within the intermediate electrode can be selected as well. Alternatively, an intermediate electrode having no field-forming electrodes can be used.

By inserting the intermediate electrode 20, the main lens electric field can be extended in the axial direction of the electron gun, thereby enlarging the effective lens diameter of the main lens. As a result, the spot diameter of the electron beam can be decreased further.

Figure 6:
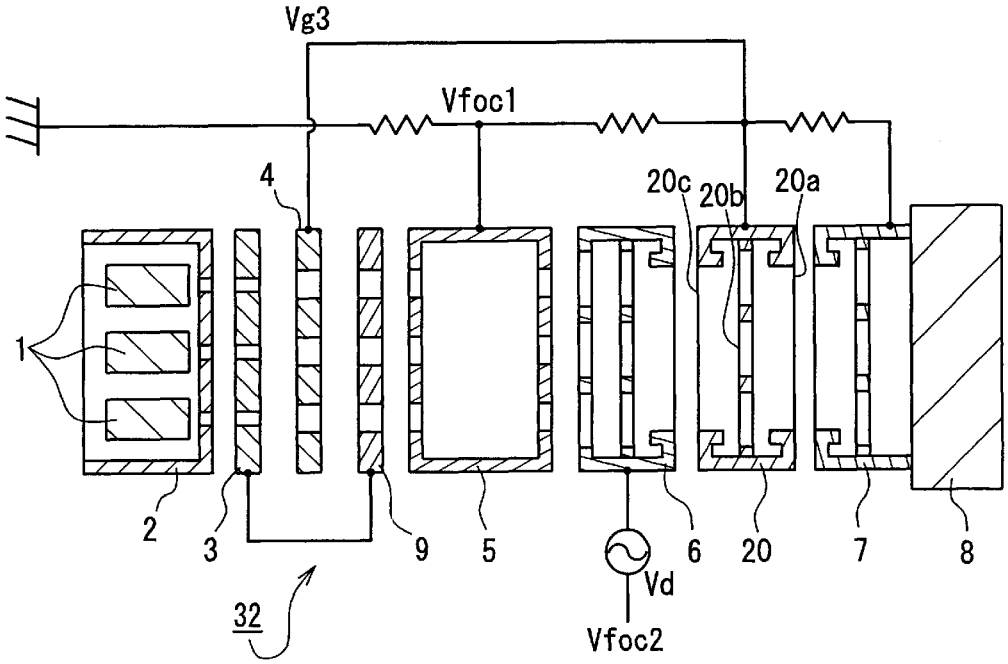
FIG. 6 is a cross-sectional view showing an electron gun according to a variation of the second embodiment of the present invention.

Voltages applied to the respective electrodes of the electron gun 31 in this embodiment are, for example, Va=29.5 kV, Vm=12 kV, Vfoc1=7 kV, and Vfoc2=6 kV. Vm is set to be higher than Vfoc1 in order to enlarge the main lens electric field in the axial direction. Vg3 applied by the resistors 10, 11 and 21 is 12 kV and higher than Vfoc1 and Vfoc2. Alternatively, as shown in FIG. 6, the intermediate electrode 20 and the G3 electrode 4 are connected electrically so as to be applied with an identical voltage of 12 kV. In this configuration, the number of extraction contacts from the resistors within the tube can be decreased. Alternatively, Vfoc1 can be divided by means of a resistor and supplied as shown in FIG. 6.

Figure 7:
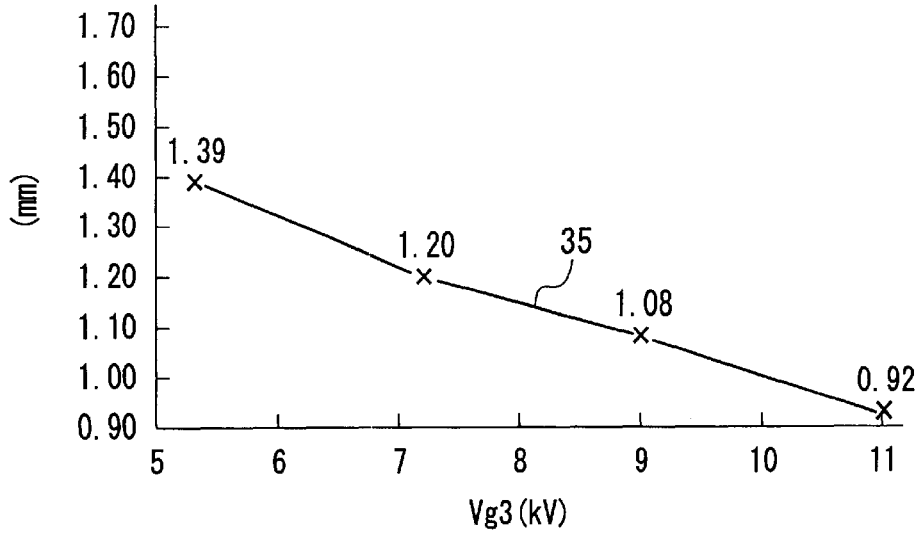
FIG. 7 is a graph showing a relationship between a voltage Vg3 and a spot diameter of an electron beam in a case of using the electron gun according to the second embodiment of the present invention.

FIG. 7 shows an experimental result for a relationship between the voltage Vg3 and a beam spot diameter for the electron gun of this embodiment. In this experiment, the values of Va, Vm, Vfoc1 and Vfoc2 were fixed respectively to 29.5 kV, 12 kV, 7 kV, and 6 kV, while only Vg3 was varied. The shapes of the apertures formed in the control electrode 2, the accelerating electrode 3 and the G3 electrode 4 were the same as those in the first embodiment.

As expressed in a line 35 in FIG. 7, the spot diameter (y-axis) is decreased as the voltage Vg3 (x-axis) is raised. In addition, in comparison with the experimental result of FIG. 4 referring to the first embodiment (line 34), the spot diameter at the same voltage Vg3 is smaller in this embodiment than in the first embodiment. The values for Vg3 over 11 kV are omitted from the figure, since there were no substantial change in the spot diameter after Vg3 exceeded this value.

In each of the electron guns described in the first and second embodiments, one set of dynamic quadrupole lens is used. Alternatively, the quadrupole lens can be used with another set of quadrupole lens having a reverse action in the horizontal and vertical directions and positioned at the cathode side. In this case, the set of quadrupole lens at the main lens side functions mainly to correct the astigmatism caused by deflection astigmatism while the quadrupole lens at the cathode side functions to mainly correct the difference in the horizontal and vertical lens magnification dynamically corresponding to the respective deflections. Alternatively, the electron gun according to the respective embodiments can be combined with a multistage focusing lens.

In each of the electron guns of the respective embodiments, an auxiliary electrode 9 is arranged between the G3 electrode 4 and the first focusing electrode 5, and the auxiliary electrode 9 is applied with the same voltage as to the accelerating electrode 3. Alternatively, the auxiliary electrode 9 can be applied with a voltage of either Vfoc1 or Vfoc2. Alternatively, plural or no auxiliary electrodes 9 can be provided.

As described above, a voltage applied to the G3 electrode is obtained by dividing with a resistor a voltage applied to the final accelerating electrode, so that the G3 electrode can be applied with a voltage separately from the first and second focusing electrodes. Therefore, the first and second focusing electrodes are applied with high voltages, and moreover, the G3 electrode can be applied with a high voltage independently for forming a prefocus lens.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, all changes that come within the meaning and range of equivalency of the claims are intended to be embraced therein.

What is claimed is:

1. A color picture tube device comprising an electron gun comprising cathodes, a control electrode, an accelerating electrode, a G3 electrode, a first focusing electrode, a second focusing electrode and a final accelerating electrode that are arranged in this order, wherein a voltage applied to the G3 electrode is obtained by dividing with a resistor a voltage applied to the final accelerating electrode; and when an electron beam is not deflected, the color picture tube device satisfies a relationship represented as:

$$Va > Vg\,3 > Vfoc2$$

where Va denotes the voltage applied to the final accelerating electrode, Vg3 denotes the voltage applied to the G3 electrode, and Vfoc2 denotes a voltage applied to the second focusing electrode.

2. The color picture tube device according to claim 1, wherein the accelerating electrode and the G3 electrode are applied with a voltage separately from the first focusing electrode and the second focusing electrode, and a lens electric field between the accelerating electrode and the G3 electrode, and a lens electric field between the first focusing electrode and the second focusing electrode are formed respectively with independently-applied voltages.

3. The color picture tube device according to claim 1, wherein the voltage applied to the G3 electrode is obtained by dividing with a resistor a voltage supplied from an anode in the color picture tube device to the final accelerating electrode, and the voltages applied to the first focusing electrode and the second focusing electrode are supplied through pins of a stem provided in the color picture tube device.

4. The color picture tube device according to claim 1, further satisfying a relationship represented as:

$$Va > Vg3 > Vfoc1 > Vfoc2$$

when the electron beam is not deflected, where Vfoc1 denotes the voltage applied to the first focusing electrode.

5. The color picture tube device according to claim 1, wherein Vg3 is higher than 9 kV.

6. The color picture tube device according to claim 1, wherein an intermediate electrode is arranged between the second focusing electrode and the final accelerating electrode, and a voltage Vm applied to the intermediate electrode is higher than Vfoc1.

7. A color picture tube device comprising an electron gun comprising cathodes, a control electrode, an accelerating electrode, a G3 electrode, a first focusing electrode, a second focusing electrode and a final accelerating electrode that are arranged in this order, wherein a voltage applied to the G3 electrode is obtained by dividing with a resistor a voltage applied to the final accelerating electrode, the color picture tube device satisfies a relationship represented as:

$$Vg3 > 9\ kV$$

and the color picture tube device satisfies also a relationship represented as:

$$Va > Vg3 > Vfoc1 > Vfoc2$$

when an electron beam is not deflected, where Va denotes the voltage applied to the final accelerating electrode, Vg3 denotes the voltage applied to the G3 electrode, Vfoc1 denotes a voltage applied to the first focusing electrode, and Vfoc2 denotes a voltage applied to the second focusing electrode.

8. The color picture tube device according to claim 7, wherein accelerating electrode and the G3 electrode are applied with a voltage separately from the first focusing electrode and the second focusing electrode, and a lens electric field between the accelerating electrode and the G3 electrode, and a lens electric field between the first focusing electrode and the second focusing electrode are formed respectively with independently-applied voltages.

9. The color picture tube device according to claim 7, wherein the voltage applied to the G3 electrode is obtained by dividing with a resistor a voltage supplied from an anode in the color picture tube device to the final accelerating electrode, and the voltages applied to the first focusing electrode and the second focusing electrode are supplied through a stem pin provided in the color picture tube device.

10. The color picture tube device according to claim 7, wherein an intermediate electrode is arranged between the second focusing electrode and the final accelerating electrode, and a voltage applied to the intermediate electrode is higher than Vfoc1.

* * * * *